US010066458B2

(12) United States Patent
Deacon et al.

(10) Patent No.: US 10,066,458 B2
(45) Date of Patent: Sep. 4, 2018

(54) INTERVENTION SYSTEM AND APPARATUS

(71) Applicant: Expro North Sea Limited, Dyce, Aberdeenshire (GB)

(72) Inventors: Paul Deacon, Aberdeen (GB); John Sangster, Aberdeen (GB)

(73) Assignee: Expro North Sea Limited, Dyce (GB)

( * ) Notice: Subject to any disclaimer, the term of this patent is extended or adjusted under 35 U.S.C. 154(b) by 82 days.

(21) Appl. No.: 15/027,385

(22) PCT Filed: Oct. 7, 2014

(86) PCT No.: PCT/GB2014/053012

§ 371 (c)(1),
(2) Date: Apr. 5, 2016

(87) PCT Pub. No.: WO2015/052499

PCT Pub. Date: Apr. 16, 2015

(65) Prior Publication Data

US 2016/0245041 A1 Aug. 25, 2016

(30) Foreign Application Priority Data

Oct. 8, 2013 (GB) ..... 1317808.2

(51) Int. Cl.

| | |
|---|---|
| ***E21B 34/02*** | (2006.01) |
| ***E21B 33/076*** | (2006.01) |
| ***E21B 33/038*** | (2006.01) |
| *E21B 34/00* | (2006.01) |

(52) U.S. Cl.
CPC ..... *E21B 34/02* (2013.01); *E21B 33/038* (2013.01); *E21B 33/076* (2013.01); *E21B 2034/002* (2013.01)

(58) Field of Classification Search
CPC ..... E21B 33/038; E21B 33/076; E21B 34/02; E21B 34/002
See application file for complete search history.

(56) References Cited

U.S. PATENT DOCUMENTS 3,533,430 A * 10/1970 Fredd ..... E21B 34/08 137/112
5,284,209 A * 2/1994 Godfrey ..... E21B 29/04 166/336
6,170,578 B1 1/2001 Edwards et al.
6,253,854 B1 * 7/2001 Fenton ..... E21B 33/043 166/363

(Continued)

FOREIGN PATENT DOCUMENTS

GB 2378724 2/2003

*Primary Examiner* — David L Andrews
*Assistant Examiner* — Dany E Akakpo

(57) ABSTRACT

A ball valve apparatus includes a housing defining a housing inlet and a housing outlet and a valve cartridge mounted within the housing and defining a cartridge flow path extending between a cartridge inlet and a cartridge outlet, wherein the cartridge inlet is arranged in fluid communication with the housing inlet and the cartridge outlet is arranged in fluid communication with the housing outlet. A ball valve member is mounted within the valve cartridge and is rotatable to selectively open and close the cartridge flow path. A leak chamber is defined between the housing and the cartridge for containing fluid leakage from the valve cartridge.

23 Claims, 7 Drawing Sheets

(56) References Cited

U.S. PATENT DOCUMENTS

| | | | | |
|---|---|---|---|---|
| 6,293,344 | B1 * | 9/2001 | Nixon | E21B 34/045 166/321 |
| 6,571,877 | B1 * | 6/2003 | Van Bilderbeek | E21B 33/03 166/339 |
| 6,584,763 | B2 | 7/2003 | Lymons et al. | |
| 6,604,355 | B1 | 8/2003 | Sternberger | |
| 8,316,632 | B2 | 11/2012 | West et al. | |
| 8,720,183 | B2 | 5/2014 | Welch et al. | |
| 8,919,668 | B2 | 12/2014 | Vauchel et al. | |
| 9,255,546 | B2 | 2/2016 | Welch et al. | |
| 2011/0030964 | A1 * | 2/2011 | Williams | E21B 34/10 166/325 |
| 2011/0112869 | A1 | 5/2011 | Greak | |
| 2014/0175317 | A1 | 6/2014 | Tennant | |
| 2015/0052875 | A1 | 2/2015 | Lohman | |
| 2015/0267643 | A1 | 9/2015 | Gonidec et al. | |
| 2015/0308379 | A1 | 10/2015 | James | |
| 2015/0308382 | A1 | 10/2015 | Aten | |

* cited by examiner

INTERVENTION SYSTEM AND APPARATUS

This application is entitled to the benefit of, and incorporates by reference essential subject matter disclosed in PCT Application No. PCT/GB2014/053012 filed Oct. 7, 2014, which claims priority to Great Britain Application No. 1317080.2 filed Oct. 8, 2013, which applications are herein incorporated by reference.

BACKGROUND OF THE INVENTION

1. Technical Field

The present invention relates to a well intervention system and apparatus, in particular a subsea well intervention system and apparatus.

2. Background Information

Current estimates suggest that there are more than 4,750 subsea wells in place globally for the production of hydrocarbons from subterranean reservoirs, with ever increasing numbers year on year. As fields mature, operators are becoming more interested in reservoir recovery, well integrity and life of field planning, which leads to an increase in well intervention requirements.

There is a significant desire within the industry for intervention systems which are genuinely light weight, yet still provide an operator with a full suite of intervention capabilities. Current systems which are considered as light weight, however, have some drawbacks. For example, current systems which are promoted as being light weight are typically performed from Category A vessels which are quite highly specialized and thus might have limited availability and demand increased rental fees. Further, such Category A deployed intervention systems have limited capabilities and are normally restricted to wireline operations and in shallower water depths. Further, such systems may be associated with increased well control risks.

Where an operator requires intervention operations which exceed the capabilities of Category A run interventions, the current primary option is to utilize very heavy weight Category C rig based interventions. The Category C rig vessels are limited in number, and thus can demand very significant rental fees. Also, the limited availability of such vessels might result in significant delays in field operations, and in extreme cases might require periods of well inactivity and thus losses in revenues. Furthermore, the equipment and infrastructure associated with such heavy weight rig based interventions can be extremely costly. In some cases operators could consider the costs of intervention to be so prohibitive that the decision could be taken to abandon the well.

Also, as the majority of well intervention operations are performed on mature wells, operators are very cautious in ensuring that the type of intervention system used will minimize the risk of damaging or compromising the aging assets. This cautious approach is also driving the demand for genuine light weight well intervention systems which can support a wide spectrum of intervention operations.

Also, any intervention system must meet and indeed exceed all the necessary legislation requirements for safety and well control. As such, the individual components must be of a robust and reliable design, minimizing the risk of failure.

SUMMARY OF THE INVENTION

According to an aspect of the present invention there is provided a ball valve apparatus, comprising: a housing defining a housing inlet and a housing outlet; a valve cartridge mounted within the housing and defining a cartridge flow path extending between a cartridge inlet and a cartridge outlet, wherein the cartridge inlet is arranged in fluid communication with the housing inlet and the cartridge outlet is arranged in fluid communication with the housing outlet; a ball valve member mounted within the valve cartridge and being rotatable to selectively open and close the cartridge flow path; and a leak chamber defined between the housing and the cartridge for containing fluid leakage from the valve cartridge.

In use, the leak chamber may function to capture and contain any fluids which may leak from the valve cartridge. Such an arrangement may provide a secondary barrier against fluid leakage into the environment.

It should be understood that although the terms "inlet" and "outlet" have been used, this is not intended to define or imply any restriction to flow direction. For example, it is not intended for flow to always be in the direction of the inlet to the outlet. Instead, the ball valve apparatus can accommodate flow in any direction, either from inlet to outlet, or outlet to inlet.

The provision of a separate valve cartridge may provide useful benefits in terms of ease of manufacture, assembly, maintenance and the like.

The ball valve apparatus may be for use in providing flow control to and/or from a wellbore, such as a wellbore for the exploration and/or production of hydrocarbons.

The ball valve apparatus may be for use subsea. As such, aspects of the present invention may relate to a subsea ball valve apparatus. The ball valve apparatus may be configured to be coupled to a wellhead, such as a subsea wellhead, for example directly coupled to a wellhead or via an interface, such as a production tree, adaptor, connector or the like.

The ball valve apparatus may define or form part of a well control package.

The ball valve apparatus may be configured for use in an intervention system, such as a subsea intervention system. The ball valve apparatus may be configured for use in a light weight intervention system.

The ball valve apparatus may define or form part of a subsea test tree.

The ball valve apparatus may define an outer diameter suitable for running through a rotary table provided on a surface vessel. For example, the ball valve apparatus may define an outer diameter which is less than 126 cm (49.5 inches).

The leak chamber may be defined by an annular space between the outer surface of the valve cartridge and an inner surface of the housing. A single leak chamber may be provided. Alternatively, multiple leak chambers may be provided.

The valve cartridge may comprise a cartridge housing. The ball valve member may be mounted within the cartridge housing.

The cartridge housing may define a pressure housing and be configured to retain pressure inside the cartridge. For example, the cartridge housing may be configured to carry hoop stress when in use. The cartridge housing may define a structural housing. In such an arrangement the cartridge housing may be configured to carry axial loading, for example as might be established by pressure end effects.

The cartridge housing may comprise a unitary component. Alternatively, the cartridge housing may comprise multiple components connected together. A sealing arrangement may be provided between individual cartridge housing components. The leak chamber may capture and contain any fluid leakage between individual cartridge housing components.

The valve cartridge may comprise at least one connector for securing individual cartridge housing components together. The connector may be configured to accommodate internal pressure. The connector may be configured to transmit loading, for example axial loading, between individual cartridge housing components. The connector may comprise a threaded connector. The connector may comprise a threaded collar for use in securing individual cartridge housing components together.

The valve cartridge may comprise a valve actuator arrangement for use in actuating the ball valve member to move between open and closed positions. The valve actuator arrangement may be mounted within the cartridge housing.

The valve actuator arrangement may be hydraulically actuated. The actuator arrangement may be configured to be actuated by a hydraulic line connected or connectable to the ball valve apparatus. Additionally, or alternatively, the actuator arrangement may be configured to be actuated by fluid within the cartridge flow path. For example, the valve actuator may be configured to be operated during flow in a particular direction along the cartridge flow path. Such an arrangement may provide pump-through capability.

The actuator arrangement may comprise a piston. The actuator arrangement may comprise a piston member and a piston housing, wherein the piston member is configured for reciprocal motion within the piston housing. The cartridge housing may define the piston housing. The piston may comprise an annular piston. The piston may be arranged coincident and/or collinear with the cartridge flow path. The piston may be arranged around the ball valve member.

The actuator arrangement may be biased. The actuator arrangement may comprise a biasing arrangement. The biasing arrangement may comprise a compression member. The biasing arrangement may comprise a tension member. The biasing arrangement may comprise one or more of: a helical spring; a Belleville spring; a resilient member; and/or the like.

The biasing arrangement may be configured to bias the valve member towards a closed position. Such an arrangement may permit the valve member to become closed in the event of a loss in actuation power, such as a loss in hydraulic power. This may permit the ball valve apparatus to function as a fail-closed valve.

The ball valve apparatus may comprise a linkage arrangement connecting the ball valve member and the actuator arrangement. The linkage arrangement may be configured to convert a linear movement of the actuation arrangement to a rotational movement of the ball valve member. The linkage arrangement may be configured to convert a force generated by (or received from) the actuation arrangement to a torque applied to the ball valve member.

The valve cartridge may be sealingly engaged with the housing. The valve cartridge may be sealingly engaged with the housing in the region of one of both of the cartridge inlet and cartridge outlet.

The cartridge inlet may be sealingly coupled to the housing inlet.

The cartridge outlet may be sealingly coupled to the housing outlet.

The ball valve apparatus may comprise an inlet sealing arrangement for providing sealed fluid communication between the cartridge inlet and the housing inlet. The leak chamber may be configured to capture and contain any fluid leakage past the inlet sealing arrangement.

The inlet sealing arrangement may comprise a sealing member, such as an O-ring interposed between the valve cartridge and the housing around the periphery of the respective inlets. The inlet sealing arrangement may comprise an axial sealing arrangement. The inlet sealing arrangement may comprise a radial sealing arrangement.

The inlet sealing arrangement may comprise an inlet sealing collar which spans an interface between the valve cartridge and the housing. In one embodiment one end of the inlet sealing collar may be received within the cartridge flow path, and an opposing end of the inlet sealing collar may be received within an inlet bore of the housing. The inlet sealing collar may comprise a first sealing member for sealing against the valve cartridge, and a second sealing member for sealing against the housing. The first and second sealing members may define radial sealing members. One or both of the first and second sealing members may comprise an O-ring.

The ball valve apparatus may comprise an outlet sealing arrangement for providing sealed fluid communication between the cartridge outlet and the housing outlet. The leak chamber may be configured to capture and contain any fluid leakage past the outlet sealing arrangement.

The outlet sealing arrangement may comprise a sealing member, such as an O-ring interposed between the valve cartridge and the housing around the periphery of the respective inlets. The outlet sealing arrangement may comprise an axial sealing arrangement. The outlet sealing arrangement may comprise a radial sealing arrangement.

The outlet sealing arrangement may comprise an outlet sealing collar which spans an interface between the valve cartridge and the housing. In one embodiment one end of the outlet sealing collar may be received within the cartridge flow path, and an opposing end of the outlet sealing collar may be received within an outlet bore of the housing. The outlet sealing collar may comprise a first sealing member for sealing against the valve cartridge, and a second sealing member for sealing against the housing. The first and second sealing members may define radial sealing members. One or both of the first and second sealing members may comprise an O-ring.

The ball valve member may define a through bore which may be aligned with the cartridge flow path when the ball valve is in an open position, and misaligned with the cartridge flow path when the ball valve is in a closed position.

The ball valve member may be configured, when closed, to provide a substantially sealed barrier within the cartridge flow path to thus prevent flow along said flow path at least in one direction. The ball valve member may be configured, when closed, to provide sealing in one direction. This may prevent fluid flow in a single direction along the cartridge flow path. The ball valve member may be configured, when closed, to provide sealing in opposite directions. This may prevent fluid flow in opposite directions along the cartridge flow path.

The ball valve apparatus may comprise a valve seat configured to cooperate with the ball valve member to provide sealing therebetween. The valve seat may be positioned within the valve cartridge.

The ball valve member may be configured to cut or sever an object or apparatus present within the cartridge flow path at the time of closing of the ball valve member. Such an arrangement may permit the ball valve member to close even when an object or apparatus is positioned within the cartridge flow path. Such objects or apparatus may be present during intervention operations performed on or in an associated wellbore.

The ball valve member may be configured to cut one or more of wireline, slickline, coiled tubing and/or tooling which may be present within the cartridge flow path.

The ball valve member may comprise a cutting edge. The ball valve member may be configured to cooperate with a valve seat to cut an object positioned therebetween. In such an arrangement a valve seat may define a corresponding cutting edge.

The ball valve member may be configured to clamp an object or apparatus present within the cartridge flow path at the time of closing of the ball valve member.

The ball valve apparatus may comprise first and second ball valve members. Each of the first and second ball valve members may be as defined above.

The first and second ball valve members may be axially arranged relative to each other.

The first and second ball valve members may be provided in a common valve cartridge.

The first and second ball valve members may be arranged along the cartridge flow path.

The first and second ball valve members may be provided in respective separate valve cartridges.

The ball valve apparatus may comprise more than two ball valve members.

The ball valve apparatus may comprise at least one sensor arranged to sense or monitor conditions within the leak chamber. Such monitoring within the leak chamber may permit an operator to detect if leakage form the valve cartridge has occurred. In one embodiment the ball valve apparatus may comprise a pressure sensor configured to sense or monitor pressure within the leak chamber.

The housing may define a structural housing. For example, the housing may be configured to accommodate loading, such as static and/or dynamic loading when in use. The housing may define a pressure housing. For example, the housing may be configured to accommodate or retain internal pressure. Such internal pressure may result from leakage from the valve cartridge.

The housing may facilitate connection or be connectable to other apparatus. For example, the housing may define one or more external connectors for use in connecting to other apparatus. At least one external connector may comprise a threaded connector, flange connector, quick release connector or the like.

The housing may facilitate connection of the ball valve apparatus within a larger system. For example, the housing may facilitate connection or be connectable to an intervention system, such as a light weight subsea intervention system.

The housing may facilitate connection or be connectable to an emergency disconnect package within a larger system, such as might be used to facilitate an emergency disconnection in a subsea application from a surface vessel or the like.

The housing may facilitate connection or be connectable to a well head or well head system or assembly. For example, the housing may facilitate direct connection to a well head system. In some embodiments the housing may facilitate connection or be connectable to a production Christmas tree, such as a horizontal or vertical Christmas tree. In some embodiments the housing may facilitate connection or be connectable to a well head system via an adaptor. The form of the adaptor may be selected in accordance with the specific well head infrastructure. For example, an adaptor having a monobore may be utilized where connection to a horizontal Christmas tree is made. Further, an adaptor having dual bores may be utilized where connection to a vertical Christmas tree is made.

In some embodiments the housing may be connected or connectable to a bore selector apparatus for use in providing selective mechanical access from the ball valve apparatus into one of multiple bores extending into a well head system. This arrangement may facilitate intervention operations to be performed on both a primary bore and an annulus of an associated wellbore. Such a bore selector apparatus may be provided in accordance with U.S. Pat. No. 6,170,578, the disclosure of which is incorporated herein by reference.

The ball valve apparatus may be provided in combination with at least one adaptor for facilitating connection to a wellhead system, such as a production Christmas tree.

The housing may be split into at least two sections to permit the valve cartridge to be installed. The housing may comprise a connector between adjacent housing sections. The housing may comprise a threaded connector. The housing may comprise a flange connector.

The housing may comprise a sealing arrangement between adjacent housing sections. Such an arrangement may provide fluid containment of any fluids which may have leaked from the valve cartridge into the leak chamber.

The housing may be longitudinally split. Alternatively, or additionally, the housing may be laterally split. In such an arrangement at least one section of the housing may define a barrel housing section.

At least one section of the housing may form part of a further apparatus. For example, at least one section of the housing may define part of a connector assembly, such as an emergency disconnect assembly.

The housing inlet may be configured to be arranged in fluid communication with an external system. In one embodiment the housing inlet may be configured to be arranged in fluid communication with a wellbore.

The housing outlet may be configured to be arranged in fluid communication with an external system. In one embodiment the housing outlet may be arranged in fluid communication with a riser, such as a marine riser which may extend to a surface vessel.

The housing outlet may be configured to be arranged in fluid communication with a lubricator stack and stuffing box, such as might be used to permit a wireline or slickline to be inserted into the ball valve apparatus.

The housing may define an inlet flow path. The inlet flow path may be in fluid communication with the cartridge flow path via the cartridge inlet.

The housing may define an outlet flow path. The outlet flow path may be in fluid communication with the cartridge flow path via the cartridge outlet.

The housing may define a port through a side wall thereof. Such a port may be utilized to facilitate fluid communication externally of the housing, for example to by-pass the valve cartridge. In some embodiments the port may permit a fluid to be injected or otherwise communicated into the housing without flowing through the valve cartridge. Such an arrangement may facilitate fluid access even when the ball valve member is closed. Such an arrangement may permit a well kill fluid to be communicated into an associate wellbore, for example as part of a well control recovery operation.

The port may be axially offset from the valve cartridge. This may permit fluid communication into the housing without flowing through the valve cartridge.

The port may be aligned with an inlet flow path of the housing. The port may be aligned with an outlet flow path of the housing.

In some embodiments a plurality of ports may be provided.

The port in the housing may be sealable, for example by applying or setting a suitable barrier, such as by closing a port valve, installing a sealing plate or the like. This arrangement may permit the ball valve apparatus to accommodate multiple uses.

One end of the valve cartridge may be installed against a support shoulder, such as an annular support shoulder, provided within the housing. Opposing ends of the valve cartridge may be installed against opposing support shoulders, such as annular support shoulders, provided within the housing. In such an arrangement the valve cartridge may be axially captivated between the opposing support shoulders within the housing.

In one embodiment the opposing support shoulders within the housing may facilitate axial load transfer between the valve cartridge and the housing.

In some embodiments a first housing section may include a first support shoulder, and a second housing section may include a second support shoulder, wherein the valve cartridge may be captivated between the support shoulders when the first and second housing sections are secured together.

The ball valve apparatus may comprise an aligning arrangement for aligning the valve cartridge within the housing. For example, the ball valve apparatus may comprise a centralizer arrangement for centralizing the valve cartridge within the housing. A sealing arrangement providing sealing between the valve cartridge and the housing may facilitate appropriate alignment between the valve cartridge and the housing.

The ball valve apparatus may comprise a local power source. Such a power source may permit operation of the ball valve apparatus in the event of failure of an external power source. The local power source may comprise a hydraulic power source. The local power source may be mounted on the housing, for example on an outer surface of the housing. The local power source may define a dead-man system.

The ball valve apparatus may comprise a Remotely Operated Vehicle (ROV) interface panel. Such an arrangement may facilitate operation by an ROV when used in a subsea environment.

The ball valve member may be configured to be closed during flow through the cartridge flow path.

According to a further aspect of the present invention there is provided a subsea system, comprising: a stress joint for connection between subsea apparatus and a surface vessel, wherein the stress joint comprises a first wall section of uniform wall thickness and an adjacent second wall section defining a tapering wall thickness for providing stress relief along the stress joint; and subsea control equipment mounted on the stress joint, wherein the subsea control equipment is connected to the first wall section of the stress joint.

Accordingly, by connecting the subsea control equipment to the first wall section which has a uniform wall thickness, the designed stress relief function of the tapering second wall section may not disturbed or altered by the presence of the subsea control equipment.

The subsea system may comprise a mechanical connection between the stress joint and the subsea control equipment. The mechanical connection may define a rigid connection. The mechanical connection may axially support the subsea control equipment relative to the stress joint. The mechanical connection may radially support the subsea control equipment relative to the stress joint.

The stress joint may comprise a support member mounted on, for example integrally formed or connected to, an outer surface of the first wall section. In such an arrangement the support member may define an axial support for the subsea control equipment.

The stress joint may comprise multiple support members. The multiple support members may be circumferentially arranged around the stress joint.

The support member may comprise an annular support shoulder.

The subsea control equipment may be for use by subsea apparatus connected to the stress joint. In such an arrangement the subsea system may comprise an interface connector to facilitate connection between the subsea control equipment and subsea apparatus.

The subsea control equipment may comprise a power source.

The subsea control equipment may comprise one or more hydraulic accumulators, for permitting accumulation of hydraulic power from an external source, for example.

The subsea control equipment may comprise electrical control equipment, such as processors and the like.

The subsea control equipment may comprise a single module.

The subsea control equipment may comprise multiple modules. In some embodiments multiple control equipment modules may be arranged circumferentially around the stress joint. Multiple control equipment modules may be evenly distributed around the stress joint. Such an arrangement may minimize bending moments applied on the stress joint by the control equipment.

The subsea control equipment may comprise at least two equivalent control modules, such as electrical control modules. This may provide a degree of redundancy, providing back-up in the event of failure of compromise of one module.

One end, for example a lower end of the stress joint may be configured for connection to subsea apparatus, such as an intervention system. For example, one end of the stress joint may be configured to be connected to an emergency disconnect package of a subsea intervention system. In such an arrangement, in an emergency disconnect situation, the stress joint may become disconnected from the subsea apparatus, this disconnecting the subsea apparatus from a surface vessel.

One end, for example an upper end of the stress joint may be connected or connectable to a riser which extends to a surface vessel.

One end, for example an upper end of the stress joint may be configured to be arranged in fluid communication with a lubricator stack and stuffing box, such as might be used to permit a wireline or slickline to be inserted into and through the subsea system.

The subsea system may form part of an intervention system, such as a light weight intervention system.

The subsea system may define an outer diameter suitable for running through a rotary table provided on a surface vessel. For example, the subsea system may define an outer diameter which is less than 126 cm (49.5 inches).

According to a further aspect of the present invention there is provided a subsea system, comprising: a stress joint for connection between subsea apparatus and a surface vessel, wherein the stress joint comprises a tapering wall thickness which tapers from a thick wall section to a thin wall section for providing stress relief along the stress joint; and subsea control equipment mounted on the stress joint, wherein the subsea control equipment is connected to the stress joint in the region of the thick wall section.

According to a further aspect of the present invention there is provided a subsea system, comprising: a lower subsea package to be mounted on a wellhead and comprising an upper end which comprises an emergency disconnect connector, wherein the emergency disconnect connector comprises a breakable joint section; an upper subsea package to be connected to a surface vessel; and a connection arrangement providing connection between the upper and lower subsea packages, wherein the connection arrangement comprises: a first connector portion mounted on the emergency disconnect connector of the lower subsea package and comprising a surface connection profile; and a second connector portion mounted on the upper subsea package and comprising at least one actuatable connection member for selectively engaging the surface connection profile of the first connector portion to provide a connection therebetween.

Accordingly, in use, the first and second connection portions may be disconnected to permit the upper subsea package to be retrieved to surface while leaving the lower subsea package in place. In such an event, the provision of the second connector portion on the upper subsea package permits this portion to also be retrieved to surface. This may provide advantages in that the second connector portion comprises at least one actuatable connection member, which may thus be appropriately inspected, maintained, serviced etc.

The first connector portion may comprise a male portion defining a connection profile on an outer surface thereof.

The second connector portion may comprise a female portion which receives the male portion of the first connector portion.

The second connector portion may comprise a plurality of connection members. The connection members may comprise or be defined by dogs.

The second connector portion may be a hydraulically operated to actuate the connection member(s).

According to a further aspect of the present invention there is provided an intervention system comprising: an adaptor portion to facilitate connection to a well head system; a well control package coupled to the adaptor portion; an emergency disconnect connector mounted above the well control package; and a stress joint mounted above the emergency disconnect connector.

The well head system may comprise a well head. For example, the adaptor may facilitate connection to a well head mandrel.

The well head system may comprise a production tree, such as a horizontal or vertical Christmas tree.

The well head system may comprise a capping stack, such as might be used in a well recovery operation.

The well control package may comprise a ball valve apparatus according to any other aspect.

The stress joint may be as defined in relation to any other aspect.

The intervention system may comprise subsea control equipment mounted on, for example around, the stress joint, such as defined in relation to any other aspect.

The intervention system may comprise a riser extending from the stress joint to a surface vessel.

The intervention system may comprise a lubricator stack and stuffing box, such as might be used to permit a wireline or slickline to be inserted into the intervention system.

The intervention system may comprise a connector to provide an interface between the adaptor and a well head system. The connector may comprise one or more actuatable connector members for engaging a profile on a well head system. The connector may comprise an H4 type connector. The connector may comprise a tree running tool.

The adaptor may comprise a generally cylindrical portion which is inserted within a connector. The adaptor may comprise a radial sealing arrangement configured to provide sealing between the generally cylindrical portion and the connector. Such an arrangement may facilitate sealing to be retained between the connector and the adaptor even in the event of some relative axial displacement therebetween.

A sealing arrangement, such as an axial sealing arrangement, may be provided between axially opposing faces of the adaptor and the connector.

The adaptor and the connector may be secured together by bolting, pining or the like.

The intervention system may comprise interchangeable adaptors, configured for use in different applications. The form of the adaptor may be selected in accordance with the specific well head infrastructure. For example, the intervention system may comprise a first adaptor having a monobore which may be utilized where connection to a horizontal Christmas tree is made. The intervention system may comprise a second adaptor having dual bores which may be utilized where connection to a vertical Christmas tree is made.

The intervention system may comprise a bore selector apparatus for use in providing selective mechanical access into one of multiple bores extending into a well head system. This arrangement may facilitate intervention operations to be performed on both a primary bore and an annulus of an associated wellbore. The bore selector apparatus may define an adaptor. The a bore selector apparatus may be provided in accordance with U.S. Pat. No. 6,170,578, the disclosure of which is incorporated herein by reference.

In some embodiments individual components of the intervention system may define an outer diameter suitable for running through a rotary table provided on a surface vessel. For example, individual components of the intervention system may define an outer diameter which is less than 126 cm (49.5 inches).

The intervention system may comprise a retainer valve located above the emergency disconnect connector for use in retaining fluids contained above the emergency disconnect connector in the event of an emergency disconnect.

According to a further aspect of the present invention there is provided a method for deploying a subsea system from a surface vessel, wherein the surface vessel comprises a drill floor having a rotary table, the method comprising: aligning a lower subsea package of the subsea system below the rotary table of the drill floor; deploying an upper subsea package of the subsea system through the rotary table; establishing a connection between the upper subsea package and the lower subsea package below the drill floor using an remotely actuated connector; and deploying the connected upper and lower subsea packages through the moonpool of the cellar deck towards a subsea location.

Accordingly, deploying the upper subsea package through the rotary table of the drill floor permits certain operations to be performed by personnel from the relative safety of the drill floor. This provides advantages over other systems in which operators may need to be suspended on suitable harnesses below the drill floor to perform necessary operations.

The method may comprise connecting an umbilical to the upper subsea package at the level of the drill floor, for example prior to connection between the upper and lower subsea packages.

The use of a remotely operated connector to establish a connection between the upper and lower subsea packages may minimize the requirement for physical intervention from personnel, thus providing benefits in terms of added safety.

The remotely operated connector may comprise a hydraulic connector.

The method may comprise securing riser sections to the upper subsea package during deployment of the subsea system. The method may comprise securing the umbilical to the outer surface of the riser sections from the level of the drill floor.

The method may comprise securing a lubricator stack and/or a stuffing box to the upper subsea package.

The vessel may comprise a cellar deck having a moonpool positioned below the drill floor. The lower subsea package may be mounted on a skidding system on the cellar deck. The skidding system may permit the lower subsea package to be aligned below the rotary table of the drill floor and above the moonpool of the cellar deck The lower subsea package may comprise well control equipment, such as a ball valve apparatus as defined in any other aspect.

The lower subsea package may comprise an emergency disconnect connector at an upper end thereof, for example positioned above well control equipment.

The upper subsea package may comprise a stress joint assembly.

The upper subsea package may comprise control equipment, for example hydraulic and/or electrical control equipment.

The subsea system may comprise an intervention system.

The features defined in relation to one aspect may be applied in any combination with any other aspect.

BRIEF DESCRIPTION OF THE DRAWINGS

These and other aspects of the present invention will now be described, by way of example only, with reference to the accompanying drawings, in which.

DETAILED DESCRIPTION

Figure 1:
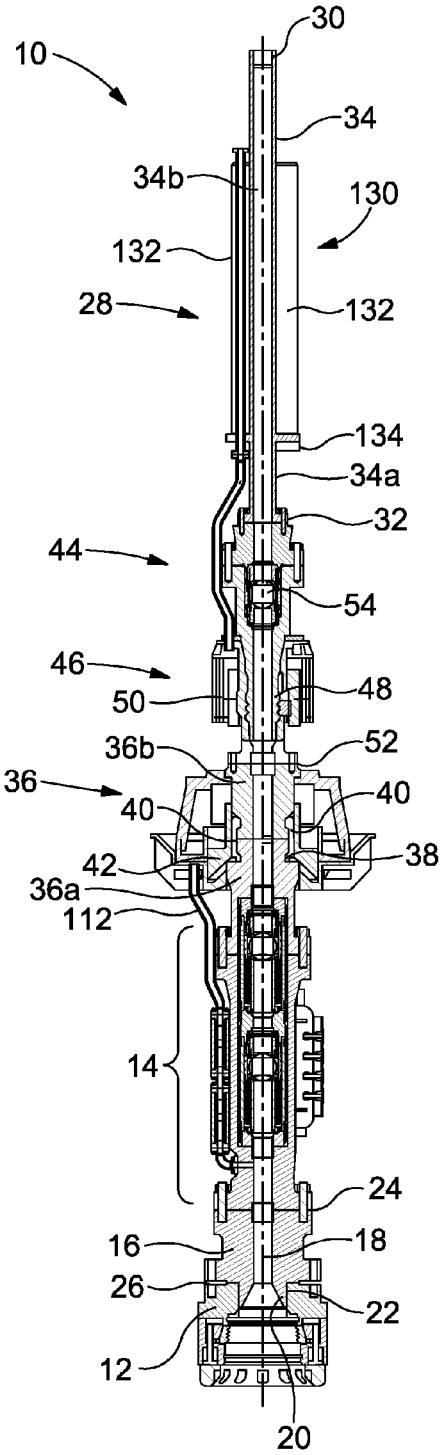
FIG. 1 is a longitudinal cross-section of a subsea intervention system according to an embodiment of the present invention.

A subsea light weight well intervention system, generally identified by reference numeral 10, in accordance with an embodiment of the present invention is illustrated in cross-section in FIG. 1. The system 10 comprises a connector, in the present embodiment an H4 type connector 12, which facilitates connection to a subsea production Christmas tree (not shown). As will be described in more detail below, the illustrated system 10 is set-up for mounting on and performing intervention operations through a horizontal Christmas tree.

The system 10 includes a well control package 14 coupled to the H4 connector 12 via an adaptor 16. The adaptor 16 in the embodiment shown includes a central monobore 18 which is configured to facilitate interfacing with a horizontal Christmas tree. The adaptor 16 includes and a generally cylindrical section 20 which extends into the connector 12 with radial O-ring seals 22 providing sealing therebetween. The provision of such radial seals may permit sealing to be maintained in the event of relative axial movement between the connector 12 and adaptor 16.

The adaptor 16 is secured to the well control package 14 via bolted flange connection 24, and similarly the adaptor 16 is secured to the H4 connector 12 via bolted flange connection 26.

The system 10 further comprises a stress joint assembly 28 mounted above the well control package 14, wherein the stress joint assembly includes upper and lower connectors 30, 32 and a pipe section 34 extending therebetween. The pipe section 34 includes a wall thickness which tapers from a thick wall section adjacent to the lower connector 32, to a thinner wall section adjacent the upper connector 30. Such a tapering wall thickness permits a gradual stress relief, particularly bending stress relief, to be achieved over the length of the stress joint assembly 28.

In the particular embodiment shown the pipe section 34 of the stress joint assembly 28 includes a lower wall section 34*a* which defines a substantially uniform wall thickness, and an upper wall section 34*b* which defines a tapering wall thickness.

The upper connector 30 of the stress joint assembly facilitates connection to a riser (not shown) which extends to a surface vessel (also not shown). The lower connector 32 of the stress joint assembly facilitates connection with the rest of the intervention system 10.

The intervention system 10 further comprises an emergency disconnect package 36 mounted intermediate the well control package 16 and the stress joint assembly 28. The emergency disconnect package 36 includes first and second connector portions 36*a*, 36*b* which are connected together in normal use as shown in FIG. 1, but which may permit disconnection in the event of an emergency situation, such as in the event of a significant deviation of a surface vessel. In the event of such an emergency disconnect the well control package 14 remains connected to the well head system and thus continues to provide well control.

The first connector portion 36*a* includes a connection profile 38 on an outer surface thereof, and the second connector portion 36*b* includes a plurality of dogs 40 which are activated by a piston 42 to selectively engage the connection profile 38. In the event of an emergency disconnect requirement, the piston 42 will stroke to de-support the dogs 40 and permit disconnection to be achieved. The first and second connector portions permit a high angle release to be achieved.

The intervention system further comprises a retainer valve assembly 44 intermediate the stress joint assembly 28 and the emergency disconnect package 36. Specifically, the retainer valve assembly 44 is connected to the stress joint assembly 28 via the lower connector 32 of the stress joint assembly 28. Further, the retainer valve assembly is connected to the emergency disconnect package 36 via a hydraulic connector arrangement 46. In the example embodiment shown in FIG. 1 the retainer valve assembly includes a male connector portion 48 which is stabbed into a hydraulically actuated female connector portion 50 which is mounted on the emergency disconnect package 36 via flange connector 52.

The retainer valve assembly 44 includes a ball valve 54 which is arranged to close in the event of an emergency disconnect, to retain fluids and any equipment in the connected riser and thus prevent release to the environment. In the embodiment shown the ball valve 54 is capable of shearing any equipment, such as coiled tubing or wireline, which might extend therethrough.

Figure 2:
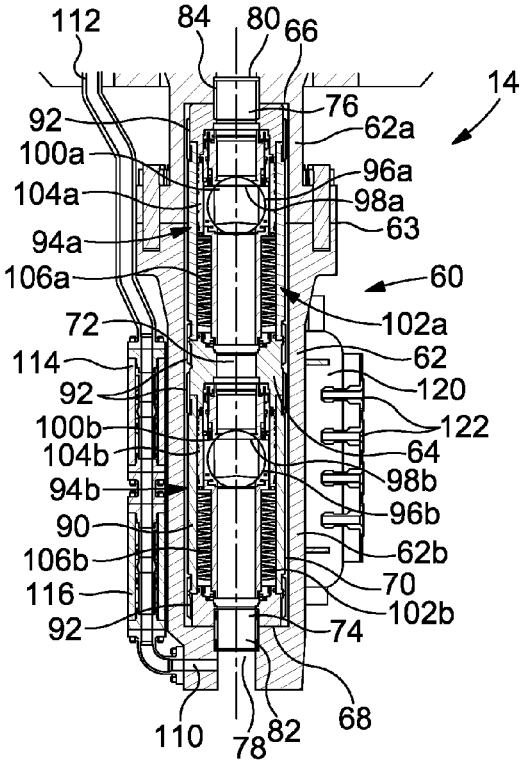
FIG. 2 is an enlarged view of a well control package of the subsea intervention system of FIG. 1.

A detailed description of the foil and construction of the well control package will now be provided, with additional reference to FIG. 2, which is an enlarged view of the intervention system 10 in the region of the well control package 14.

The well control package 14 includes a ball valve apparatus 60 having an outer housing 62 which is split into an upper housing part 62*a* and a lower housing part 62*b*, connected together via a sealed flange connector 63. The housing 62 defines a structural housing and facilitates or accommodates load transfer when coupled within the entire system 10.

A valve cartridge 64 is mounted within the housing 62 and is axially captivated between opposing shoulders 66, 68 provided within the respective housing parts 62*a*, 62*b*. Such axial captivation is achieved during assembly of the upper and lower housing parts 62*a*, 62*b* together.

When the valve cartridge 64 is installed within the housing 62 an annulus 70 is established therebetween. As will be described in further detail below, this annulus 70 defines a leak chamber which collects and retains any fluid which may have leaked from the valve cartridge 64, thus providing a secondary barrier to leakage into the environment.

The valve cartridge 64 defines a cartridge flow path 72 extending between a cartridge inlet 74 and a cartridge outlet 76, wherein the cartridge inlet 74 is arranged in fluid communication with a housing inlet 78 and the cartridge outlet 76 is arranged in fluid communication with a housing outlet 80. An inlet sealing collar 82 spans the interface between the cartridge inlet 74 and housing inlet 78. Similarly, an outlet sealing collar 84 spans the interface between the cartridge outlet 76 and housing outlet 80. Each sealing collar 82, 84 includes radial O-rings seals, and when in place the collars 82, 84 function to isolate the cartridge flow path 72, and indeed the flow path through the entire system 10, from the annulus 70. As such, any leakage from the seal collars 82, 84 can be addressed be retaining the leaked fluid within the annulus 70.

The valve cartridge 64 is generally cylindrical and elongate in form, and comprises a cartridge housing 90 which is composed of multiple parts secured together via threaded collars 92. The connections between individual cartridge housing components is such that sealing is provided therebetween. Thus, in the event of any leakage at the connectors 92, any leaked fluid will become retained within the annulus 70.

Although not illustrated in the drawings, the system further comprises a pressure sensor which is arranged to monitor pressure within the annulus 70, such that any leakage into the annulus 70 may be detected.

In the embodiment illustrated the cartridge 64 comprises two axially arranged ball valve assemblies 94*a*, 94*b* mounted within the cartridge housing 90. Each ball valve assembly 94*a*, 94*b* includes a rotatable ball valve member 96*a*, 96*b* which comprises a through bore 98*a*, 98*b*. When each ball valve member 96*a*, 96*b* is rotated to align the respective through bores 98*a*, 98*b* with the cartridge flow path 72, the flow path 72 will be open and flow will be permitted. However, when each ball valve member 96*a*, 96*b* is rotated to misalign the through bores 98*a*, 98*b* from the cartridge flow path 72, as illustrated in FIGS. 1 and 2, the flow path 72 is closed and flow is prevented.

In the embodiment illustrated each ball valve member 96*a*, 96*b* includes a leading cutting edge 100*a*, 100*b* which is capable of cutting an object, such as coiled tubing or wireline, which might extend through the well control package 14 at the time of closure of the ball valve members 96*a*, 96*b*. In such a case, the ball valve assemblies 94*a*, 94*b* may be considered to be shear and seal valves.

Each ball valve assembly 94*a*, 94*b* includes an actuation arrangement 102*a*, 102*b* for selectively causing rotation of the respective ball valve members 96*a*, 96*b*. In the embodiment illustrated each actuation arrangement 102*a*, 102*b* includes a hydraulically operated piston sleeve 104*a*, 104*b* which is secured to a respective ball valve member 96*a*, 96*b* via a linkage mechanism (not shown). Further, each actuation arrangement 102*a*, 102*b* includes a baising spring 106*a*, 106*b*, specifically Bellville spring stacks, which provide a baising force on the respective piston sleeves 104*a*, 104*b*. In use, hydraulic pressure may be applied to the piston sleeves 104*a*, 104*b* to cause said sleeves to stroke and cause the ball valve members 96*a*, 96*b* to rotate towards their open positions via the linkage mechanisms, while also compressing or energizing the associated springs 106*a*, 106*b*. When hydraulic pressure is removed, either deliberately or in the event of an unintentional loss, the springs 106*a*, 106*b* act to return the respective pistons 104*a*, 104*b* and rotate the ball valve members 96*a*, 96*b* towards their closed positions. Thus, in the embodiment illustrated the ball valve assemblies 94*a*, 94*b* function as fail-closed assemblies.

The provision of a valve cartridge 64 which is separate and distinct from the outer structural housing 62 can provide significant advantages. For example, the cartridge facilitates ease of assembly, and possible maintenance. Further, the separate cartridge can permit the presence of a secondary leak barrier, specifically the annulus 70 to be created.

The well control package 14 further comprises a side port 110 in the side wall of the outer housing 62 at a location below the valve cartridge 64. This port can facilitate the ability to establish fluid communication with an associated well bore system even in the event of the valve cartridge 64 closing. In the example embodiment shown the port 110 is connected to a conduit 112 (via dual ball valves 114, 116), which can be arranged in fluid communication with a fluid source. Such an arrangement may permit a well kill fluid, for example, to be pumped into an associated well system, for example to regain well control.

The well control package 14 further comprises an onboard hydraulic power system 120 which stores hydraulic power for use in an emergency system, such as when a remotely provided hydraulic power supply fails. Such an arrangement may define a dead-man safety system. Further, the well control package may comprise an ROV interface 122 to permit intervention by an ROV if necessary.

Figure 3:
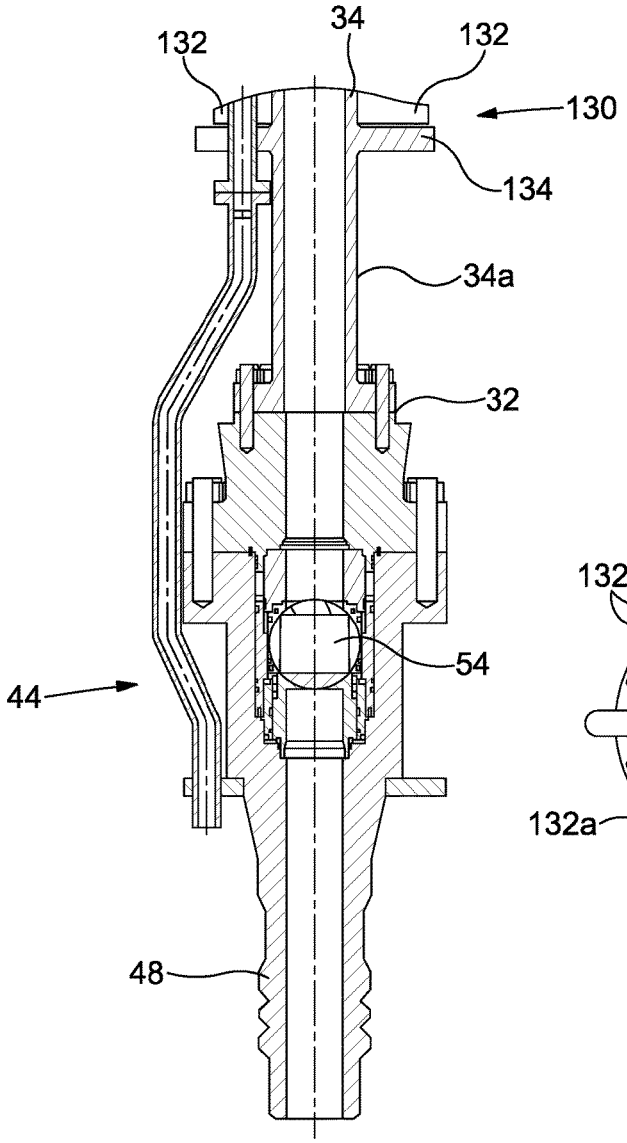
FIG. 3 illustrates a lower region of a stress joint portion of the subsea intervention system if FIG. 1.
Figure 4:
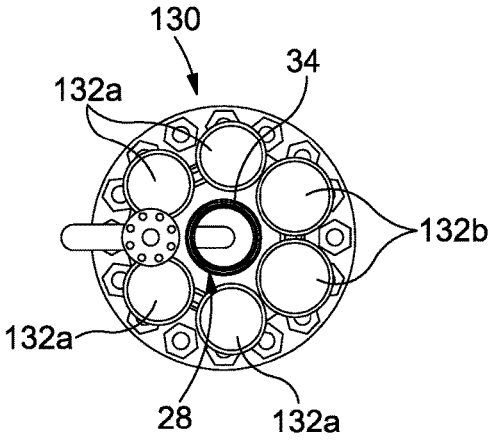
FIG. 4 is a view from above of the stress joint portion of FIG. 3.

Reference is again made to FIG. 1, in combination with FIGS. 3 and 4, wherein FIG. 3 is an enlarged view of a lower portion of the stress joint assembly 28, and FIG. 4 is a view of the stress joint assembly 28 from above. The intervention system 10 further comprises a control system 130 which is mounted around the stress joint assembly 28. The control system 130 includes a plurality of individual modules 132 which are circumferentially distributed around the pipe section 34 of the stress joint assembly 28, as most clearly illustrated in FIG. 4.

The control modules 132 may comprise suitable hydraulic and/or electrical control systems required for proper operation of the well intervention system 10. In the specific embodiment shown the control system 130 includes four hydraulic accumulator modules 132*a* and two electrical control modules 132*b*. The electrical control modules 132*b* may be configured similarly or identically, which may provide a degree of redundancy within the system 10 in the event of failure of one of the modules 132*b*.

In the embodiment illustrated the stress joint assembly 28 includes an annular support shoulder 134 extending from the lower wall section 34*a* of the stress joint pipe section 34. As described above, this lower wall section 34*a* is of a uniform wall thickness. The individual modules 132 are axially supported and connected to the stress joint assembly 28 via the annular support shoulder. Such an arrangement can permit the individual modules to be supported by the stress joint assembly 28 in a relatively compact manner. Further, as the annular support shoulder, and thus mechanical connection, is located at the portion of the stress joint pipe 34 which defines a uniform wall thickness, there will be minimal effect to the stress relief function of the adjacent tapering wall section 34*b*.

Also, in the illustrated embodiment, the individual modules 132 are substantially evenly circumferentially distributed around the stress joint assembly. Such an arrangement may prevent any adverse bending loads being applied on the system 10.

Figure 5:
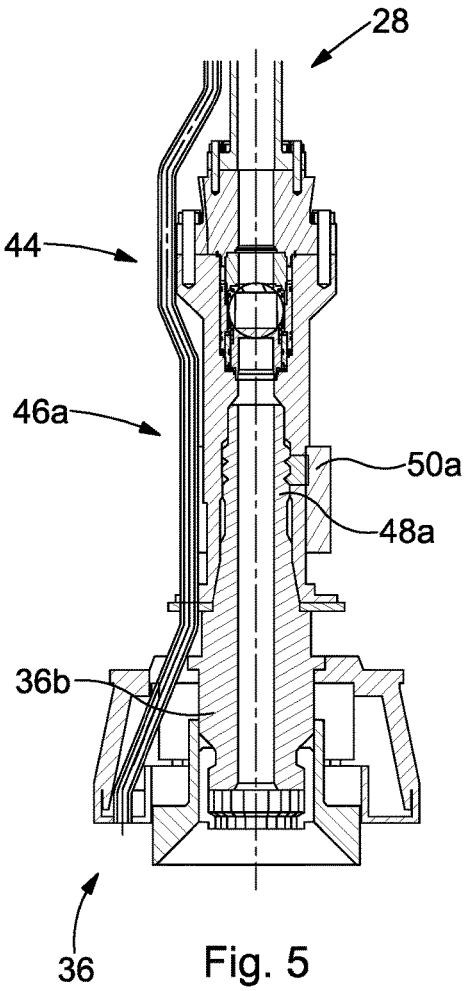
FIG. 5 is a cross-sectional view of an emergency disconnect package of a subsea intervention system in accordance with an alternative embodiment of the present invention.

In the embodiment illustrated in FIG. 1, the retainer valve assembly 44 is connected to the emergency disconnect package 36 via a hydraulic connector arrangement 46, and specifically the retainer valve assembly 44 includes a downwardly facing male connector portion 48 which is stabbed into an upwardly facing hydraulically actuated female connector portion 50 which is mounted on the emergency disconnect package 36 via flange connector 52. However, in an alternative embodiment, as shown in FIG. 5, the connector arrangement, now illustrated by reference numeral 44*a*, includes a hydraulic connector 50*a* which is mounted on the retainer valve assembly 44, and a male connector portion 48*a* which is provided on the emergency disconnect package, specifically on the second connector portion 36*b* of the emergency disconnect package. As in the previous embodiment, this arrangement may permit the connector arrangement 46*a* to be broken to allow the upper stress joint assembly 28 and retainer valve assembly 44 to be retrieved to surface. However, as the hydraulic female connector portion 50*a* in the present embodiment is secured to the retainer valve assembly, this connector portion 50*a* can also be advantageously retrieved to surface and may be inspected, repaired or the like.

Furthermore, by providing the male portion 48*a* on the emergency disconnect package 36, the additional flange 52 (FIG. 1) may be eliminated.

Figure 6:
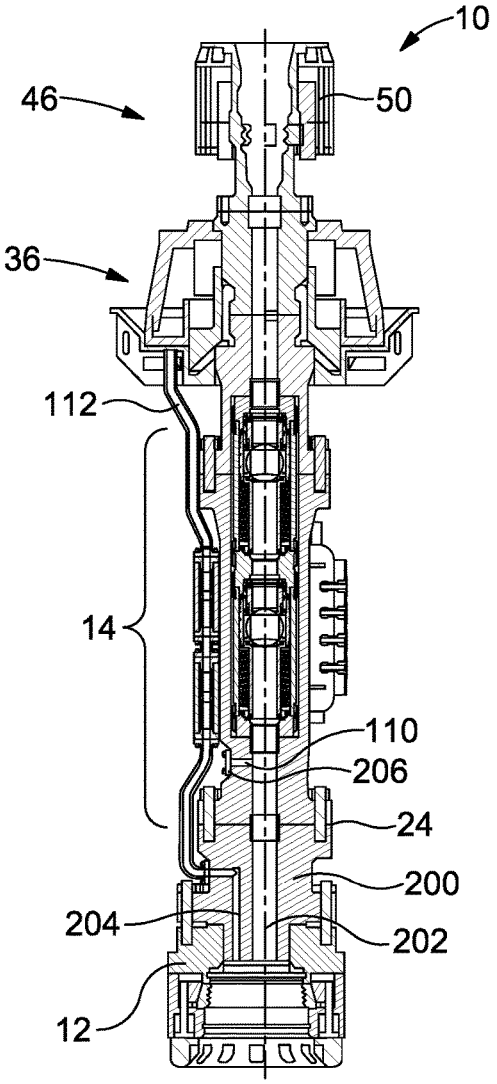
FIG. 6 is a cross-sectional view of a portion of a subsea intervention system in accordance with a further embodiment of the present invention.

In the embodiment described above the intervention system 10 is configured for use with a horizontal Christmas tree by use of a specific monobore adaptor 16. However, the system 10 may be utilized in combination with alternative wellhead infrastructure by use of an alternative adaptor and some possible reconfiguration of associated hydraulic lines. In one embodiment, as illustrated in FIG. 6, the same intervention system 10 (in this case the stress joint assembly 28 and retainer valve assembly 44 are not shown for clarity) as first illustrated in FIG. 1 may be utilized in combination with a vertical Christmas tree (not shown), by use of a specific adaptor 200 which replaces adaptor 16 (FIG. 1). Specifically, adaptor 200 is interposed between the well control package 14 and the tree connector 12. The adaptor 200 includes a primary bore 202 which is aligned with the bore extending through the intervention system 10 and establishes communication with a production wellbore, and a secondary bore 204 which is intended to communicate with a wellbore annulus. The fluid conduit 112 is fluidly coupled to the secondary bore 204 and may facilitate fluid communication into a wellbore annulus separately from the production bore. As illustrated in FIG. 6, the side wall port 110 is sealed by a cap plate 206.

It should be noted that all features relating to the intervention system 10 of FIG. 6 are largely as presented in relation to FIG. 1, and as such no further description will be provided.

Figure 7:
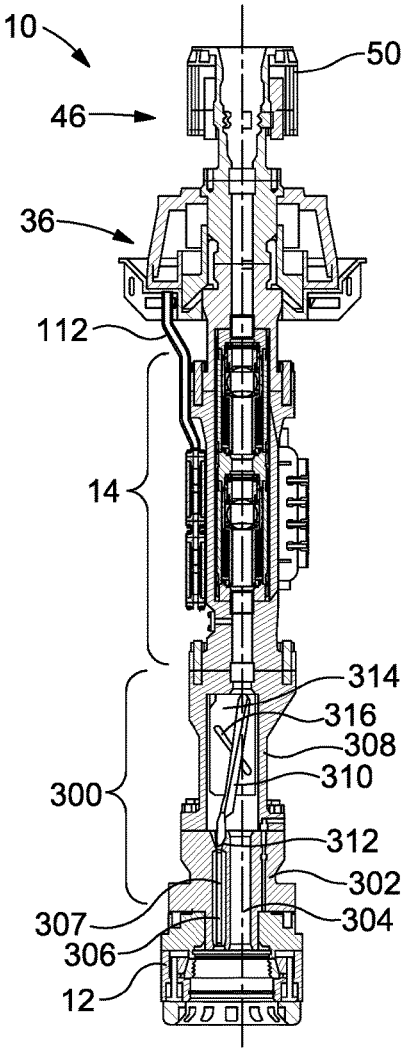
FIG. 7 is a cross-sectional view of a portion of a subsea intervention system in accordance with a further embodiment of the present invention.

FIG. 7 provides a further alternative use of the intervention system 10 (the stress joint assembly 28 and retainer valve assembly 44 again not shown for clarity) by employing a further alternative adaptor arrangement, in this case identified by reference numeral 300. It should be understood that the intervention system 10 largely remains as illustrated in FIG. 1, and as such no further detailed description will be given.

In this embodiment the adaptor 300 includes a dual bore sub 302 which includes a primary bore section 304 and an annulus bore section 306. When the system 10 is secured in this case to a vertical Christmas tree, the primary bore section 304 is aligned with a primary production bore, and the annulus bore section 306 is aligned with a wellbore annulus. The annulus bore section 306 may comprise a valve assembly 307, such as a ball valve assembly.

The adaptor 300 further comprises a bore selector sub 308 which is interposed between the well control package 14 and the dual bore sub 308. The bore selector sub may be provided in accordance with the bore selector disclosed in U.S. Pat. No. 6,170,578, the disclosure of which is incorporated herein by reference.

The bore selector sub 308 includes a pivoting plate 310 which is mounted within the bore selector sub 308 to pivot about pivot point 312. An hydraulically operated actuator sleeve 314 is connected to the side of the plate 310 via a pin and slot arrangement 316, such that stroking of the sleeve 314 causes the plate 310 to pivot, thus providing bore selection to allow a tool or other component to be inserted into the selected bore (either bore 304 or bore 306) via the intervention system 10.

In the embodiments described above, the intervention system is intended to be secured to a surface vessel via a riser. However, in other arrangements the intervention system may permit a wire-in-water type wireline intervention system to be established. Such an arrangement is diagrammatically illustrated in FIG. 8, reference to which is now made.

In this embodiment the intervention system 10 is largely as first defined with reference to FIG. 1, and as such comprises an adaptor 16, well control package 14, emergency disconnect package 36, retainer valve 44 and stress joint assembly 28. No further detailed description of these components will be provided, except to say that in the diagrammatic illustration of FIG. 8 the system 10 is shown connected to a horizontal Christmas tree 350 which in turn is mounted on a well head 352. In the present embodiment the stress joint assembly 28 of the intervention system 10 is secured to a lubricator stack and a stuffing box 360 which permits sealed insertion of wireline 362 into the intervention system.

Figure 8:
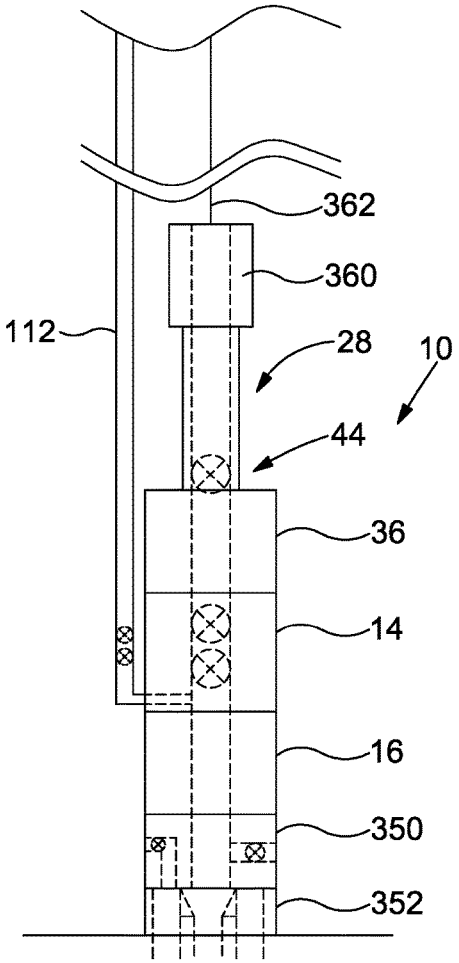
FIG. 8 is a diagrammatic illustration of a subsea intervention system in accordance with another embodiment of the present invention.

It should be understood that the arrangements shown in FIGS. 6 and 7 may also be modified in the same manner as in FIG. 8 to provide a wire-in-water system. Reference is now made to FIGS. 9A to 9J which illustrate an exemplary procedure for deploying the system 10 first shown in FIG. 1.

Figure 9A:
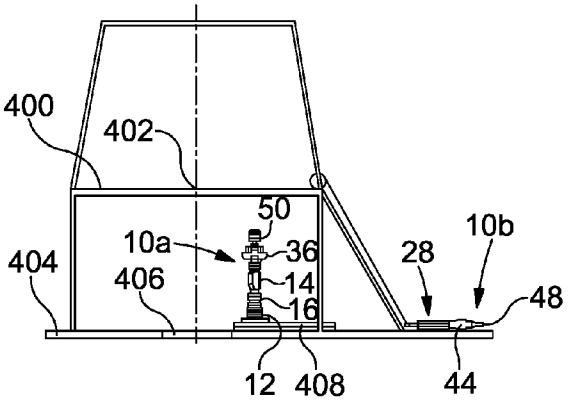
FIGS. 9A to 9J illustrate a running sequence for use in deploying the subsea intervention system of FIG. 1.

Referring initially to FIG. 9A, the deploying vessel includes a drill floor 400 which includes a rotary table 402. Located below the drill floor 400 is a cellar deck 404 which includes a moonpool 406 aligned directly below the rotary table 402. Such an arrangement is quite typical of many vessels, such as Category B type vessels, which may provide more readily availability and attract lower rental rates compared with other vessel types, such as Category C vessel types. This may present significant cost savings to an operator.

During the initial deployment stage, as illustrated in FIG. 9A, a lower portion 10*a* of the system 10 is mounted on a skid 408 on the cellar deck 404. Specifically, the lower portion 10*a* of the system 10 includes the connector 12, adaptor 16, well control package 14, emergency disconnect package 36 and the female connector portion 50 of the hydraulic connector 46. An upper portion 10*b*, which includes the male stab-in connector 48, retainer valve 44 and stress joint assembly 28, is prepared for pick-up.

Figure 9B:
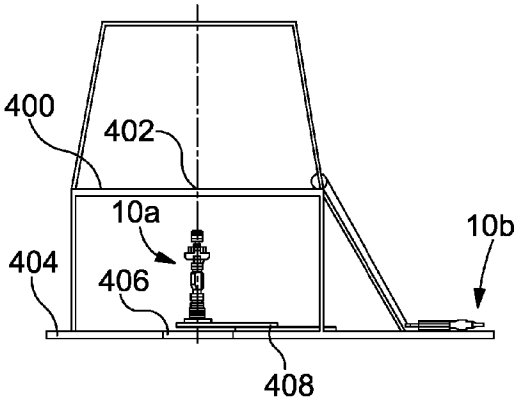
Figure 9C:
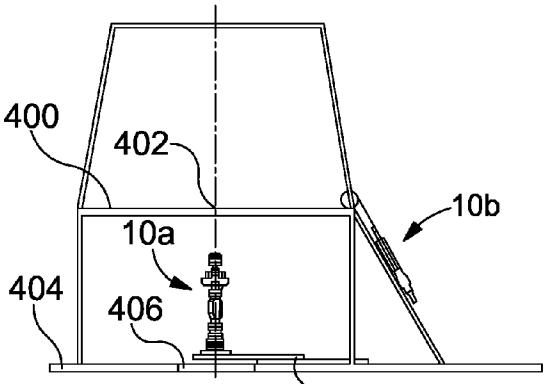
Figure 9D:
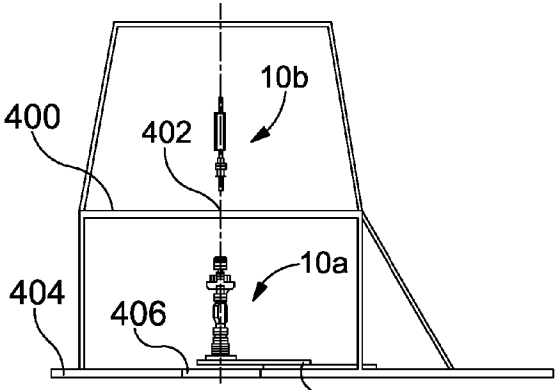

During the subsequent step, as illustrated in FIG. 9B, the lower portion 10*a* of the system is moved to be positioned over the moonpool 406 and below the rotary table 402 via the skid system 408, and the upper system portion 10*b* is then picked-up and hoisted above the drill floor 400 and aligned with the rotary table, as illustrated in FIGS. 9C and 9D.

Figure 9F:
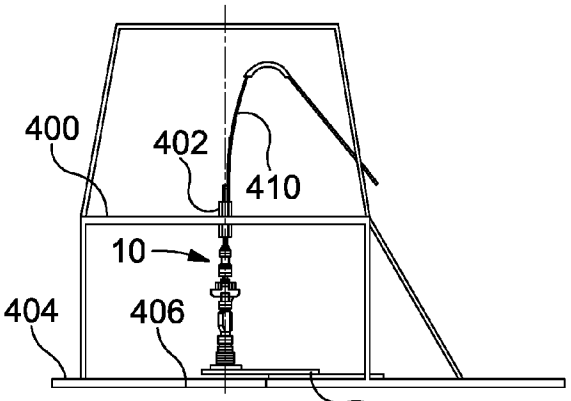
Figure 9H:
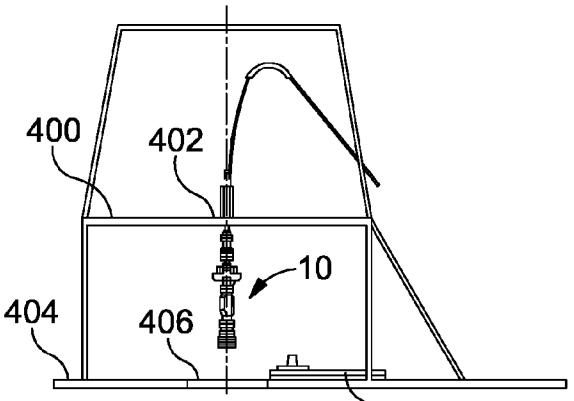
Figure 9E:
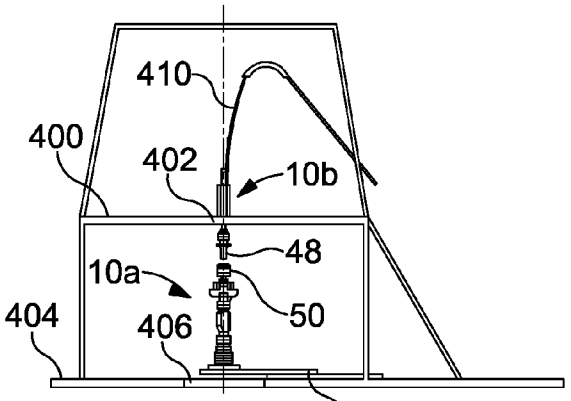

The upper system portion 10*b* may then be lowered through the rotary table, which is permitted by the precise design of the system, and connection to an associated umbilical 410 made, as illustrated in FIG. 9E. In this respect this particular running sequence enabled by the particular system design 10 advantageously facilitates connection of the umbilical 410 to be made by personnel safely working at the level of the drill floor 400. In other systems in which passage of any part of an intervention system through a rotary table (which may be less than 126 cm (49.5 inches)) is not possible, such connections would need to be made by personnel working at significant height, for example above the cellar deck 404, via man-rider systems and the like, which exposes personnel to risk.

Following this the upper system portion 10*b* may be lowered until the male connector portion 48 stabs into the hydraulic female connector portion 50, with the complete connected system illustrated in FIG. 9F. In this respect, the use of a hydraulic connector for establishing the connection between the upper and lower system portions 10*a*, 10*b* eliminates any requirement for personnel to work at height over the cellar deck 404.

Figure 9G:
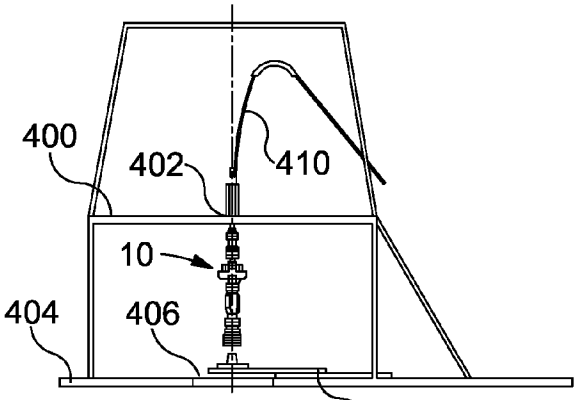
Figure 9I:
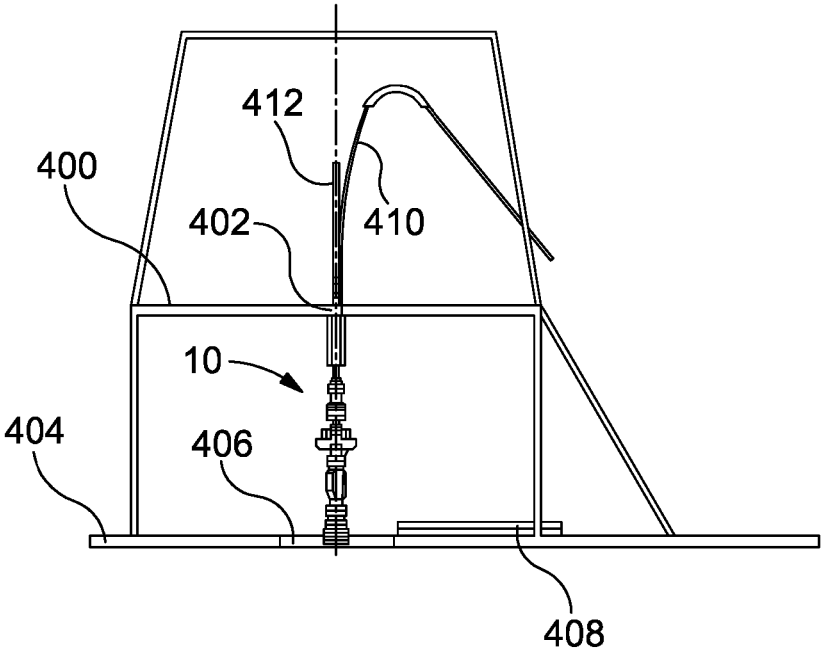
Figure 9J:
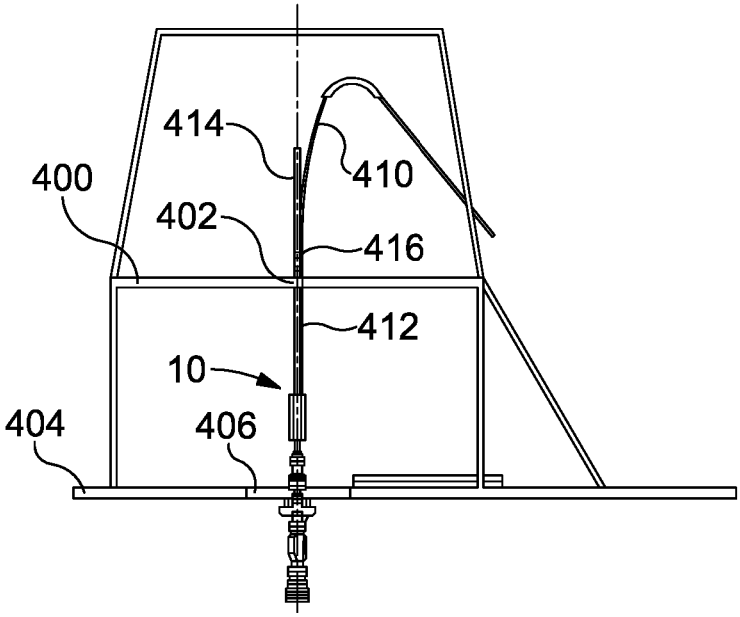

Subsequent to this, the entire system 10 may be lifted from the skid 408, as in FIG. 9G, with the skid 408 subsequently retracted, as in FIG. 9H. The system 10 may then be lowered further until the upper end may be hung via slips set in the rotary table 402, as shown in FIG. 9I. At this stage a first riser section 412 may be secured to the upper end of the system 10, again from the level of the drill floor 400. The system 10 may then be released from the slips in the rotary table 402, and subsequently lowered further, now passing through the moonpool 406, as shown in FIG. 9J. The system 10 may once again be suspended, this time via slips engaging riser section 412, permitting a further riser section 414 to be connected, again from the safe level of the drill floor 400. Also, personnel working on the drill floor 400 may readily and safely attach clamps 416 for securing the umbilical 410 to the riser section.

This procedure may be repeated until the total water depth has been reached, and the system 10 can be landed on a Christmas tree.

It should be understood that the embodiments described herein are merely exemplary, and that various modifications may be made thereto without departing from the scope of the invention.

What is claimed is:

1. A ball valve apparatus, comprising:

a housing defining a housing inlet and a housing outlet;

a valve cartridge comprising a cartridge housing which defines a pressure housing operable to retain pressure inside the cartridge housing, the valve cartridge being mounted within the housing and defining a cartridge flow path extending between a cartridge inlet and a cartridge outlet, wherein the cartridge inlet is arranged in fluid communication with the housing inlet and the cartridge outlet is arranged in fluid communication with the housing outlet;

a ball valve member mounted within the cartridge housing and being rotatable to selectively open and close the cartridge flow path;

a valve actuator arrangement mounted within the valve cartridge for actuating the ball valve member between open and closed positions; and a leak chamber defined between the housing and the cartridge housing for containing fluid leakage from the valve cartridge.

2. The ball valve apparatus according to claim 1, deployable through a rotary table provided on a surface vessel.

3. The ball valve apparatus according to claim 1, wherein the leak chamber is defined by an annular space between an outer surface of the valve cartridge and an inner surface of the housing.

4. The ball valve apparatus according to claim 1, wherein the cartridge housing comprises multiple housing components sealingly secured together.

5. The ball valve apparatus according to claim 1, wherein the valve cartridge comprises a valve actuator arrangement for use in actuating the ball valve member to move between open and closed positions.

6. The ball valve apparatus according to claim 5, wherein the valve actuator arrangement is hydraulically actuated by hydraulic pressure delivered via a hydraulic line connected or connectable to the ball valve apparatus.

7. The ball valve apparatus according to claim 5, wherein the actuator arrangement is operable by fluid flow along the cartridge flow path in a particular direction.

8. The ball valve apparatus according to claim 5, wherein the actuator arrangement comprises a piston member and a piston housing defined by the cartridge housing, wherein the piston member is reciprocally mounted within the piston housing.

9. The ball valve apparatus according to claim 8, wherein the piston comprises an annular piston arranged coincident and/or collinear with the cartridge flow path and around the ball valve member.

10. The ball valve apparatus according to claim 5, wherein the actuator arrangement comprises a biasing arrangement for biasing the valve member towards a closed position.

11. The ball valve apparatus according to claim 5, comprising a linkage arrangement connecting the ball valve member and the actuator arrangement, wherein the linkage arrangement is operable to convert a linear movement of the actuation arrangement to a rotational movement of the ball valve member.

12. The ball valve apparatus according to claim 1, wherein the valve cartridge is sealingly engaged with the housing in the region of one of both of the cartridge inlet and cartridge outlet.

13. The ball valve apparatus according to claim 1, comprising at least one of an inlet sealing arrangement for providing sealed fluid communication between the cartridge inlet and the housing inlet, and an outlet sealing arrangement for providing sealed fluid communication between the cartridge outlet and the housing outlet.

14. The ball valve apparatus according to claim 1, comprising an inlet sealing collar which spans an interface between the valve cartridge and the housing, wherein one end of the inlet sealing collar is received within the cartridge flow path, and an opposing end of the inlet sealing collar is received within an inlet bore of the housing, the inlet sealing collar comprising a first sealing member for sealing against the valve cartridge, and a second sealing member for sealing against the housing.

15. The ball valve apparatus according to claim 1, comprising an outlet sealing collar which spans an interface between the valve cartridge and the housing, wherein one end of the outlet sealing collar is received within the cartridge flow path, and an opposing end of the outlet sealing collar is received within an outlet bore of the housing, the inlet sealing collar comprising a first sealing member for sealing against the valve cartridge, and a second sealing member for sealing against the housing.

16. The ball valve apparatus according to claim 1, wherein the ball valve member is operable to cut or sever an object or apparatus present within the cartridge flow path at the time of closing of the ball valve member.

17. The ball valve apparatus according to claim 1, wherein the ball valve member is a first ball valve member, and the ball valve apparatus further comprises a second ball valve member, wherein the first and second ball valve members are axially arranged relative to each other.

18. The ball valve apparatus according to claim 1, comprising at least one sensor arranged to sense or monitor conditions within the leak chamber.

19. The ball valve apparatus according to claim 1, wherein the housing comprises one or more external connectors for use in connecting to other apparatus such that the housing facilitates connection of the ball valve apparatus within a larger system.

20. The ball valve apparatus according to claim 1, wherein at least one section of the housing defines part of an emergency disconnect assembly.

21. The ball valve apparatus according to claim 1, wherein the housing defines an inlet flow path in fluid communication with the cartridge flow path via the cartridge inlet, and an outlet flow path in fluid communication with the cartridge flow path via the cartridge outlet.

22. The ball valve apparatus according to claim 1, wherein the housing defines a port through a side wall thereof for facilitating fluid communication externally of the housing and by-passing the valve cartridge.

23. The ball valve apparatus according to claim 1, wherein opposing ends of the valve cartridge are installed against opposing support shoulders provided within the housing such that the valve cartridge is axially captivated between the opposing support shoulders within the housing.

* * * * *